US006855199B1

(12) United States Patent
Pruckner

(10) Patent No.: US 6,855,199 B1
(45) Date of Patent: Feb. 15, 2005

(54) CONDUCTIVE MINERALIC COATING FOR ELECTROCHEMICAL CORROSION PROTECTION OF STEEL REINFORCEMENT IN CONCRETE

(75) Inventor: Franz Pruckner, Asker (NO)

(73) Assignee: Protector AS, Miondalen (NO)

( * ) Notice: Subject to any disclaimer, the term of this patent is extended or adjusted under 35 U.S.C. 154(b) by 0 days.

(21) Appl. No.: 09/890,610

(22) PCT Filed: Feb. 3, 2000

(86) PCT No.: PCT/NO00/00034

§ 371 (c)(1),
(2), (4) Date: Oct. 25, 2001

(87) PCT Pub. No.: WO00/46421

PCT Pub. Date: Aug. 10, 2000

(30) Foreign Application Priority Data

Feb. 4, 1999 (NO) ..... 19990509

(51) Int. Cl.[7] ..... C04B 12/04
(52) U.S. Cl. ..... 106/600; 204/196.01
(58) Field of Search ..... 106/600; 204/196.01

(56) References Cited

U.S. PATENT DOCUMENTS 5,366,600 A 11/1994 Westhof et al.

FOREIGN PATENT DOCUMENTS

| | | |
|---|---|---|
| EP | 0 581 433 | 2/1994 |
| EP | 0 730 046 | 9/1996 |
| GB | 2140456 | 11/1984 |

*Primary Examiner*—Paul Marcantoni
(74) *Attorney, Agent, or Firm*—Wenderoth, Lind & Ponack, L.L.P.

(57) ABSTRACT

A method is described for the electrochemical protection of reinforcement in concrete in harsh environments, for instance in contact with, or in close proximity to, seawater. On concrete, a composition comprising graphite dispersed in a curable mineralic binder in the form of water glass or another water-soluble inorganic silicate, a dispersion agent, optionally together with conventional additives is applied. The application is performed by spraying or brushing. An impregnation is optionally performed, either concurrent with the application of the composition or thereafter. If necessary a post treatment is performed. Further, the use of the composition for electromechanical protection or reinforcement in concrete in connection with, for instance, quay constructions, bridges, bridge piers and similar constructions is described.

5 Claims, No Drawings

CONDUCTIVE MINERALIC COATING FOR ELECTROCHEMICAL CORROSION PROTECTION OF STEEL REINFORCEMENT IN CONCRETE

The present invention relates to a conductive mineralic coating to be used for electrochemical protection against corrosion of steel reinforcement in concrete. More specifically the invention relates to a method for electrochemical protection of reinforcement in concrete in harsh environments, as well as the use of a conductive coating for the protection of concrete in said environments.

It has been known for several decades that inorganic binders, such as concrete, in particular Portland cement, which has basic properties, protects metals containing iron against corrosion. Due to this protective effect against corrosion it has been possible to make reinforced concrete where the steel is embedded in concrete, and no protection has been required, for instance in the form of protective paint, on the steel.

The corrosion protecting effect of the concrete is due to the formation of calcium hydroxide during the hydratisation, leading to a pH value of 12 or more inside the concrete paste.

Because of carbonation, which means that the carbon dioxide of the air reacts with calcium hydroxide, the pH value may decrease several pH units. At pH values under 9 the steel reinforcement will start to corrode.

Corrosion is accelerated by formation of cracks in the building material as well as by the effect of chlorides from contaminated aggregates, de-icing salts, air pollution and seawater.

A method for preventing corrosion of steel in concrete is to polarise the steel cathodically (cathodic protection, electrochemical chloride removal, electrochemical realkalisation), where the steel is acting as the cathode, or the negative pole, and an external anode as the positive pole. As such external anodes use has been made of Ti-meshes, treads or rods coated with mixed metal oxides, electrically conducting asphalt, flame sprayed zinc or titanium or conductive paints. An electrically conductive paint has two important advantages. First of all it does not add extra weight to the construction, which may be a problem for slim constructions from a static point of view. Secondly, the conductive paint provides an excellent current distribution.

The existing paints are substantially composite materials with a polymer (acrylates, latex, polystyrene or the like) as a film forming binder (vehicle) and graphite as filler, or so-called skeleton conductor. The binder of these prior paints has practically no conductivity, but is present in the material as a binder adhering to the concrete. The anode is thereby composed of fibres or grains of graphite embedded in an insulator. The conduction will proceed via these points of contact and one would therefore expect a considerable strain at the interphase graphite/graphite. This will to a very considerable degree limit the conductivity of the anode, which has to be compensated by an increased number of connection points (often called "primary anodes"). In addition, the high transfer resistance from such an anode to the concrete has the effect that a higher voltage will be required. This leads to electrolysis and oxidation of graphite causing loss of adhesion due to acidification of the concrete subbase and decreased conductivity of the paint, thus the anode will "die". It should be added that synthetic binders are diffusion preventing and may therefore not be regarded as durable in harsh environments. The paint will further lose its adhesion to the concrete subbase due to the electrochemical reactions taking place at the inter-phase between concrete and paint, which lead to failure of the electrochemical treatment.

Major corrosion damages are occurring on concrete in harsh, or extreme, environments, as for instance in contact with, or in close proximity to, seawater. In environments like this new requirements are also placed on the anode materials, since also these materials will be subject to extensive corrosion. As an example mention may be made of a quay construction prone to corrosion of the reinforcement. The only possibility for solving this problem has been cathodic protection, preferably with Ti meshes embedded in shot-crete, installed under the quay. This is a cumbersome and expensive procedure. Delamination of these layers is also taking place to a considerable degree. It has been proven to be impossible to use the previously known paint systems under such wet or humid conditions. This is due to the fact that extensive delamination and/or blistering will take place due the humidity present, and it will often be problematic to attain sufficient adhesion already during the initial application of the paint film.

The prevailing opinion within the art is therefore that conductive paints are not applicable under these harsh and humid conditions. At present the embedding of conductive meshes is thus regarded as the only, albeit unsatisfactory, solution.

The purpose of the present invention is to provide a new and simple solution to this problem, more specifically to provide an easily applicable, mechanically and electrochemically stable anode embodiment which also to functions well in humid environment and in close proximity to, or in contact with, sea water.

For the solution of this problem the inventor has realised the necessity of avoiding film forming coatings, and has thereby developed a very simple and suitable system.

It is known that silicate based mineralic paints react with the substrate (plaster, concrete, stone etc.) by petrification. This means that the water soluble silicates penetrate the mineralic substrate upon which they have been applied and form a chemical micro-crystalline bond with said substrate, in contrast to film-forming paints which form a surface skin.

Saunders describes, in U.S. Pat. No. 4,035,265, a conductive paint for application on walls and the like for heating purposes. The paint composition contains carbon particles together with flakes of graphite, and further a curable binder such as an inorganic silicate binder, an organic ammonium silicate binder or for instance a resin binder, which is soluble in organic solvent. Due to the intended use as heat source this paint contains large amounts of graphite/carbon particles. There are also considerable further differences, to be described in greater detail below, between this system and the present invention.

The present invention thus provides a method for electrochemical protection of reinforcement in concrete in harsh environments, for instance in contact with, or in close proximity to, sea water, whereby a composition comprising graphite dispersed in water glass or another inorganic silicate, a dispersing agent and optionally conventional additives, is applied to the concrete by spraying or painting, and optionally an impregnation is carried through, either concurrent with, or after, the application of the said composition. Optionally a post treatment may also be performed.

Since the method according to the invention does not lead to the formation of any film, but rather an impregnation, the above mentioned problems connected to adhesion, delamination and blistering do not occur. The mineralic composition will penetrate the outer layer of the concrete and form a gel-like material in the pores and on the concrete surface, and will therefore, when the water evaporates, adhere strongly to the surfaces of, for instance, concrete masonry and natural stone. The transfer resistance between anode and concrete will thus be as low as possible.

When the cathodic protection installation is energised the voltage field that arises will entail migration of ions which leads to further curing and strengthening of the anode. Due to the strength of the cured coating the graphite particles will be totally immobilised and function as a well-established skeleton whereby a highly conductive anode for electrochemical treatments is obtained. As a consequence the method according to the present invention may be operated at higher current densities than the previously known paint coatings. The higher current densities will further be attained at lower voltage than with known types of anodes. This will strongly affect the lifetime of the anode in a positive direction.

Since the solution/dispersion of the mineralic compounds used in the composition are highly alkaline the delamination effects due to acidification of the inter-phase coating/concrete caused by the electrochemical process at the anode are strongly reduced. An anode according to the state of the art with latex or acrylic binder will, in contrast, lose adhesion over time due to this process. This feature is of major importance since acid will be generated at the anode/concrete interface. With the alkaline coating according to the present invention a reservoir against acid formation is obtained, which is very desirable for preventing delamination of the conductive paint due to acidification, especially at the beginning of any cathodic protection treatment where higher protective current densities are needed.

Another positive effect caused by this type of anode for cathodic protection is that the electrical field will draw alkali ions from the coating composition into the concrete by electrophoretic movement. This leads to an increased degree of polymerisation of the silica gel, which thereby will become increasingly petrified and resistant. After a certain time a completely insoluble matrix of silicate hydro-gel will be formed as binder. The silicate composition used in the method according to the invention is thus excellently suitable as anode in the cathodic protection of very humid structures, such as for instance under quay installations, harbour installations or bridge piers, where conventional paints up to now have failed.

The coating composition may, in the method according to the invention, be applied by simple spraying on the surface of the concrete, for instance with conventional paint spraying devices or brushed on the surface by using conventional equipment.

As mentioned earlier, conventional additives may, if desired, be added to the coating composition used. Among these curing agents may also be added. As curing agents use may for instance be made of phosphates of aluminium, iron, zinc, lead and so forth, polyvalent esters or ammonium, amine or amide compounds. As mentioned earlier the current through the applied impregnation itself will effect sufficient curing. Situations may arise, however, where addition of a curing agent may be advantageous, for instance before the passing of current is possible or before other protection is in place.

According to one possible embodiment of the present invention a catalyst may be added to the coating composition. As catalyst use may be made of precious metals, heterocyclic compounds with interstitial metal atoms and so forth. It has been observed that doping of the graphite with precious metals inhibits oxidation of the graphite. The coating composition containing graphite doped with precious metals has a reduced overpotential for the anodic reaction compared to undoped paint. In particular doped graphite in combination with the silicate binder as described above has proven to be a very suitable CP anode for humid or wet environments.

An impregnation agent may further be applied, either concurrent with the application of the anode or thereafter. As an impregnating agent use may for instance be made of a low viscosity solution of for instance silanes/siloxanes in order to make the surface hydrophobic. Since silanes/siloxanes will be an integrated part of the silica gel a long lasting hydrophobic behaviour may be expected, leading to an increased lifetime for the anode. A similar impregnation will, due to adhesion problems not be possible on a plastic based binder.

In order to further perfect the anode solution in connection with the to present invention the anode may be supplied with an ionic reservoir or an "ionic mantel". This is advantageous because when the anode is applied over carbonated concrete the ion content of this carbonated concrete is very low, which implies a high resistance in the concrete close to and underneath the anode. (As a comparison a Ti mesh will for instance be cast into new uncarbonated concrete with a far higher ionic content under the anode.) The current will thus be limited by the resistance of the concrete. As a consequence of the increased resistance the voltage will have to be increased. A high voltage will, over time, result in a premature breakdown of the anode due to graphite oxidation, which is dependent on the anode potential. In general, the higher the voltage, the more aggressive the situation at the anode.

Another reason for the low ionic content is the electrochemical removal of ions (cations to the cathode and anions, as $OH^-$ and $Cl^-$ to the anode and which leaves the anode as oxygen and chlorine gas) and electro-osmotic removal of water under the anode.

The low ionic content is compensated in an excellent way since the coating composition used according to the present invention itself contains ions. When high current densities are required over a long time, (as in the case of strongly corroding reinforcement, humid areas) a further layer of ionic material may be applied over the anode in order to provide a reservoir of ions. By such an ionic reservoir high current densities by low voltages are made possible.

Such an ionic reservoir may for instance be constituted by silicate paints ("concrete paints"), water glass mortars, cement, and cementitious products. In particular water glass mortars and cementitious coatings may provide an ionic reservoir of long durability in order to secure elevated current densities.

Due to the impregnating character of the coating used according to the invention delamination will not take place.

The following, non-limiting examples will illustrate the present invention.

EXAMPLES

The following examples describe different embodiments of the coating composition used in the method according to the invention.

Example 1

A coating of the following composition was prepared:

175 parts of potassium silicate solution K35

5 parts of carbon black dispersion (25%)

2 parts of detergent 50 parts of graphite 5 parts of calcium hydroxide.

The water glass containing component must be added to the coating composition a few hours before the coating is to be applied.

Example 2

A coating of the following composition was prepared:

175 parts of potassium silicate solution K35

10 parts of carbon black dispersion (25%)

2 parts of detergent 1 part of "Aerosil"

3 parts of calcium hydroxide 60 parts of graphite 11 parts of sodium aluminate (5% solution).

The water glass reactive component, the sodium aluminate, must be added to the composition a few hours before the coating is to be applied.

What is claimed is:

1. A method for the cathodic protection of steel reinforcement in concrete which comprises applying to the concrete a composition comprising:

a) a graphite dispersed in b) a curable inorganic silicate binder, c) a dispersing agent and d) a gelling agent which reacts with said silicate binder to cause gelation thereof in pores of said concrete.

2. The method of claim 1 wherein the gelling agent is sodium aluminate or calcium hydroxide.

3. The method of claim 1 wherein the binder is water glass.

4. The method of claim 1 wherein the composition further contains:

a silane or siloxane as an impregnation agent for said concrete.

5. The method of claim 1 wherein a layer of ionic material is applied over said composition.

* * * * *